US011697127B2

(12) United States Patent
Hofman

(10) Patent No.: US 11,697,127 B2
(45) Date of Patent: Jul. 11, 2023

(54) SHOWERHEAD ASSEMBLY WITH DUAL NOZZLE MOUNT

(71) Applicant: ETL, LLC, Sparks, NV (US)

(72) Inventor: David Hofman, Reno, NV (US)

(73) Assignee: ETL, LLC, Sparks, NV (US)

( * ) Notice: Subject to any disclaimer, the term of this patent is extended or adjusted under 35 U.S.C. 154(b) by 0 days.

(21) Appl. No.: 17/679,628

(22) Filed: Feb. 24, 2022

(65) Prior Publication Data

US 2022/0176391 A1 Jun. 9, 2022

Related U.S. Application Data

(63) Continuation of application No. 16/884,949, filed on May 27, 2020, now Pat. No. 11,278,920.

(60) Provisional application No. 62/948,563, filed on Dec. 16, 2019.

(51) Int. Cl.

| | |
|---|---|
| ***B05B 1/18*** | (2006.01) |
| ***E03C 1/06*** | (2006.01) |
| ***B05B 1/16*** | (2006.01) |
| ***B05B 15/62*** | (2018.01) |
| ***B05B 15/652*** | (2018.01) |

(52) U.S. Cl.

CPC ..... *B05B 1/185* (2013.01); *B05B 1/1663* (2013.01); *B05B 15/62* (2018.02); *B05B 15/652* (2018.02); *E03C 1/06* (2013.01)

(58) Field of Classification Search

CPC ..... B05B 1/18; B05B 1/185; B05B 15/62; B05B 15/652; B05B 1/1663; E03C 1/06

See application file for complete search history.

(56) References Cited

U.S. PATENT DOCUMENTS

| | | | | |
|---|---|---|---|---|
| 4,901,927 | A | 2/1990 | Valdivia | |
| 6,286,158 | B1 | 9/2001 | Lin | |
| 6,643,862 | B2 | 11/2003 | Aitken | |
| 6,775,865 | B1 | 8/2004 | Lin | |
| 7,194,775 | B2 * | 3/2007 | Leung | B05B 1/18 4/601 |
| 7,360,723 | B2 | 4/2008 | Lev | |
| 7,900,295 | B2 | 3/2011 | Lev | |
| 9,757,742 | B2 | 9/2017 | Alcamo | |
| 10,232,384 | B2 | 3/2019 | Hawkins | |
| 2013/0161420 | A1 * | 6/2013 | Tseng | E03C 1/06 239/581.1 |

(Continued)

*Primary Examiner* — Qingzhang Zhou

(74) *Attorney, Agent, or Firm* — David Duckworth; One LLP

(57) ABSTRACT

An improved showerhead assembly is provided for use with handheld showerheads. The handheld showerhead includes an elongate handle and a showerhead face including one or more nozzles for spraying water. In addition, the showerhead assembly includes a hollow mount for affixing to the male threaded pipe found in a shower stall. The mount includes a "C" shaped receptacle for holding the handheld shower assembly, an inlet for receiving water, as well as an outlet for expelling water to a flexible hose, which in turn is connected to the handheld showerhead. In addition, the mount includes supplemental spray assemblies which are affixed to the left side, right side or both sides of the "C" shaped receptacle. The supplemental spray assemblies can be rotated so as to expel water through different spray nozzle configurations.

10 Claims, 10 Drawing Sheets

(56) References Cited

U.S. PATENT DOCUMENTS

| | | | |
|---|---|---|---|
| 2018/0257090 | A1 | 9/2018 | Hawkins |
| 2019/0217313 | A1 | 7/2019 | Yang |

* cited by examiner

SHOWERHEAD ASSEMBLY WITH DUAL NOZZLE MOUNT

RELATED APPLICATIONS

The present application is a continuation of U.S. patent application Ser. No. 16/884,949, filed May 27, 2020, which in turn, claims benefit to now U.S. Provisional Patent Application Ser. No. 62/948,563 filed on Dec. 16, 2019.

BACKGROUND OF THE INVENTION

The present invention relates to showerheads. More particularly, the present invention relates to handheld showerheads producing a plurality of spray patterns.

Showerheads are commercially available in numerous designs and configurations for use in showers, faucets, spas, sprinklers and other personal and industrial systems. The vast majority of showerheads include spray heads which may be categorized as being either stationary or oscillating and have either fixed or adjustable openings. Stationary spray heads with fixed jets are the simplest constructions consisting essentially of a central channel connected to one or more spray nozzles directed to produce a constant pattern. The stationary spray showerheads cause water to flow through the construction to contact essentially the same points on a user's body in a repetitive fashion.

Multifunction showerheads are able to deliver water in many different spray patterns such as a fine spray, a coarse spray, a pulsating spray, or even a flood pattern providing high fluid flow but decreased velocity. Of course, many other spray patterns may also be provided.

A conventional multifunction showerhead generally requires the user to turn a selector ring or dial on the showerhead faceplate in order to select a desired function. Another approach is to provide a faceplate with several spray nozzles located in concentric circular patterns. An internal controller, such as controlled by buttons or the like, may be operated to direct the incoming water to any of the various patterns. Examples of such constructions are disclosed in U.S. Pat. Nos. 5,433,384 and 6,622,945.

A handheld showerhead assembly typically includes a hollow handle connected to a water supply by a flexible rubber hose. The handle has a proximal end which typically has a threaded inlet for connecting to a rubber hose. Meanwhile, at the handle's distal end, the showerhead assembly includes a showerhead including a plurality of nozzles for ejecting water. Typically, the handle and showerhead face are angled relative to one another so that water is ejected at approximately 90° relative to the handle's longitudinal axis.

Advantageously, the showerhead handle allows users to manipulate the spray nozzles into various positions and alignment to assist in the cleaning process. Unfortunately, though handheld showerheads provide many advantages compared to their fixed showerhead counterpart, handheld showerheads still suffer from several disadvantages. For example, many handheld shower assemblies do not allow a user to direct water to multiple locations at the same time.

More recently, shower stalls have been provided with a primary showerhead, and additional nozzles which project directly from the shower stall's walls which spray water in different directions than the primary showerhead. Unfortunately, these constructions require that expensive plumbing additions be made to the shower stall facility. Further, the wall nozzles cannot be moved to provide the variety that would be desirable for a shower user.

Thus, it would further be advantageous to provide a showerhead assembly that included a primary showerhead as well as one or more supplemental showerhead nozzles which can direct water to different locations within a shower stall.

Further, it would be advantageous to provide a showerhead assembly that included rotatable supplemental nozzles that did not require expensive modifications to the traditional shower stall architecture such as the introduction of additional plumbing within the walls of the shower stall.

SUMMARY OF THE INVENTION

The present invention addresses the aforementioned disadvantages by providing an improved handheld showerhead assembly which includes a mounting structure for supporting a handheld showerhead. The showerhead assembly includes a traditional handheld showerhead including a primary showerhead having a plurality of nozzles for expelling water such as within a shower. The handheld showerhead further includes a hollow handle with a proximal end which preferably is threaded for connecting to a flexible hose. The handle is elongate so as to define a longitudinal axis, and preferably, the distal end of the handle affixes to the showerhead at an angle, such as 45° to 90°. Additionally, the handheld showerhead includes a channel having an inlet for receiving water for being expelled from the showerhead nozzles. Various channel, conduit and nozzle constructions can be determined by those skilled in the art for diverting water from the inlet to the showerhead's nozzles. In the preferred embodiment, the showerhead includes a controller knob for selecting a desired shower spray pattern.

Moreover, the showerhead assembly of the present invention further possesses a hollow mounting structure with a "C" shaped receptacle for receiving the proximal end of the hollow handle. The mount has an inlet which preferably is threaded for connecting to a water supply such as a male threaded pipe projecting from a shower stall wall. Preferably, the mount's housing is affixed to the inlet by a ball joint so as to allow the mount to swivel about the ball joint's center. The mount's housing has a central channel that delivers water to a primary hose outlet and delivers water to a pair of nozzle conduits, which in turn, deliver water to each side of the "C" shaped receptacle.

In the preferred embodiment, the showerhead assembly's mount includes a pair of supplemental rotating sprayer assemblies that are rotatably affixed to each side of the "C" shaped receptacle. To this end, the showerhead assembly's mount includes a pair of posts that extend horizontally from each side of the "C" shaped receptacle. Meanwhile, each of the two sprayer assemblies have a six-sided housing including an end face, an engaging face, and four spray faces with each of the four spray faces having one or more nozzles. The engaging face includes a bore for rotatable receipt of the "C" shaped receptacle's post with this rotatable attachment enabling each of the sprayer assemblies to rotate about the horizontal axis.

The engagement face further includes four inlets with each inlet in fluid communication with one of the four spray face's one or more nozzles, respectively. The inlets are positioned so that one of the four inlets aligns with a mount's nozzle conduit with rotation of a sprayer assembly enabling a person to select any one of the four inlets to align with the nozzle conduit. Thus, each sprayer assembly includes four spray faces that are selectively connectable to a nozzle conduit for receipt and subsequent spraying of water. Preferably, each of the four spray faces 79 have different nozzle sizes and patterns to provide different spray functions.

Preferably, each of the rotatable sprayer assemblies' engaging faces includes four notches and each side of the "C" shaped receptacle includes spring-loaded tab which selectively align and engage to lock rotation sprayer assemblies when in a desired position. More specifically, the nozzle configuration changes with alignment of a nozzle conduit's outlet to its corresponding nozzles' inlet, and the sprayer assembly orientation is locked when the spring-loaded tab engages with the chosen spray face's corresponding notch. Preferably, the mount assembly includes a valve construction consisting of an on/off button which permits and/or obstructs water flow into the nozzle conduits to the sprayer assemblies' nozzles. Even more preferably, water flow is blocked by depression of the valve button, and conversely, water flow is promoted when the button is not depressed. Additional or alternative valve assemblies for providing these capabilities can be selected by those skilled in the art.

Advantageously, the showerhead assembly provides greater flexibility in providing spray patterns in the shower environment.

Also advantageously, the showerhead assembly does not require expensive modifications to the traditional shower stall architecture.

Other features and advantages of the present invention will be appreciated by those skilled in the art upon reading the detailed description which follows with reference to the drawings.

DETAILED DESCRIPTION OF THE INVENTION

Figure 1:
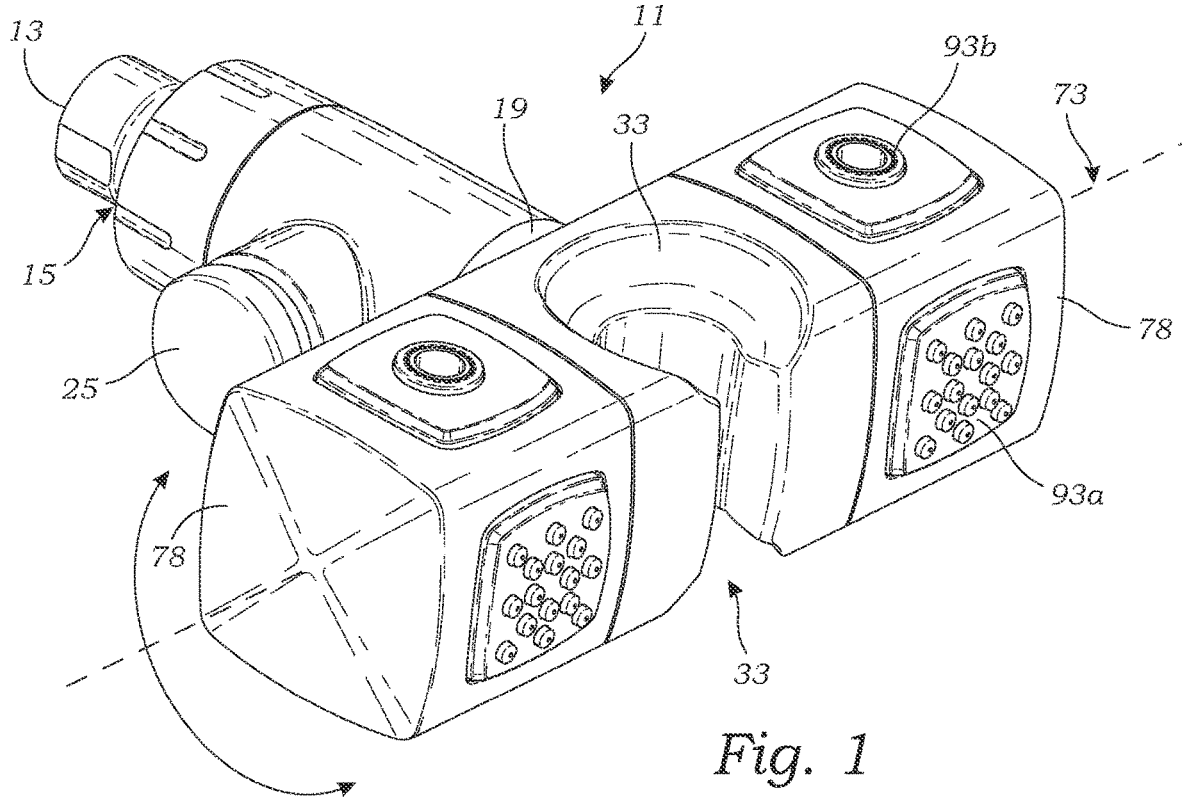
FIG. 1 is a front perspective view of a showerhead mount with rotating sprayer assemblies illustrating that the mount's sprayer assemblies can be rotated about the horizontal axis.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

Figure 2:
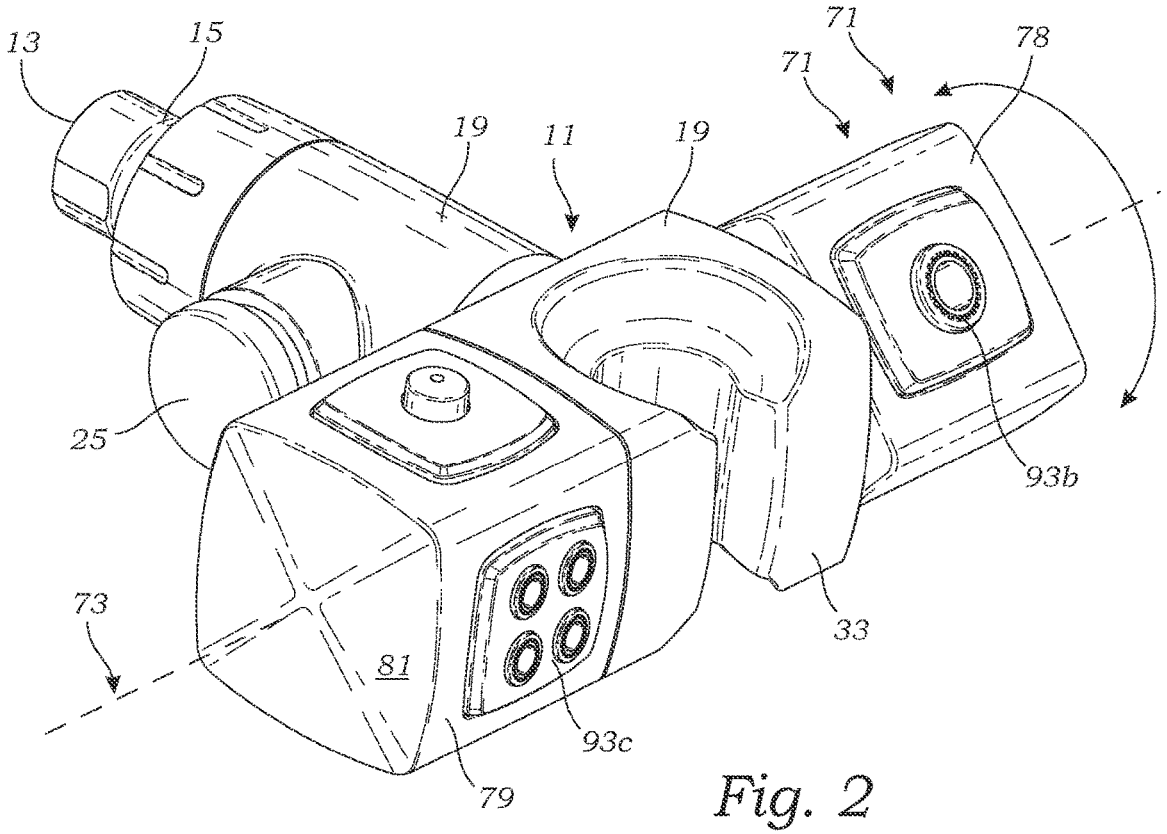
FIG. 2 is a front perspective view of the showerhead mount with rotating sprayer assemblies illustrating that the mount's right perspective rotating sprayer assembly has been rotated about the horizontal axis.
Figure 3:
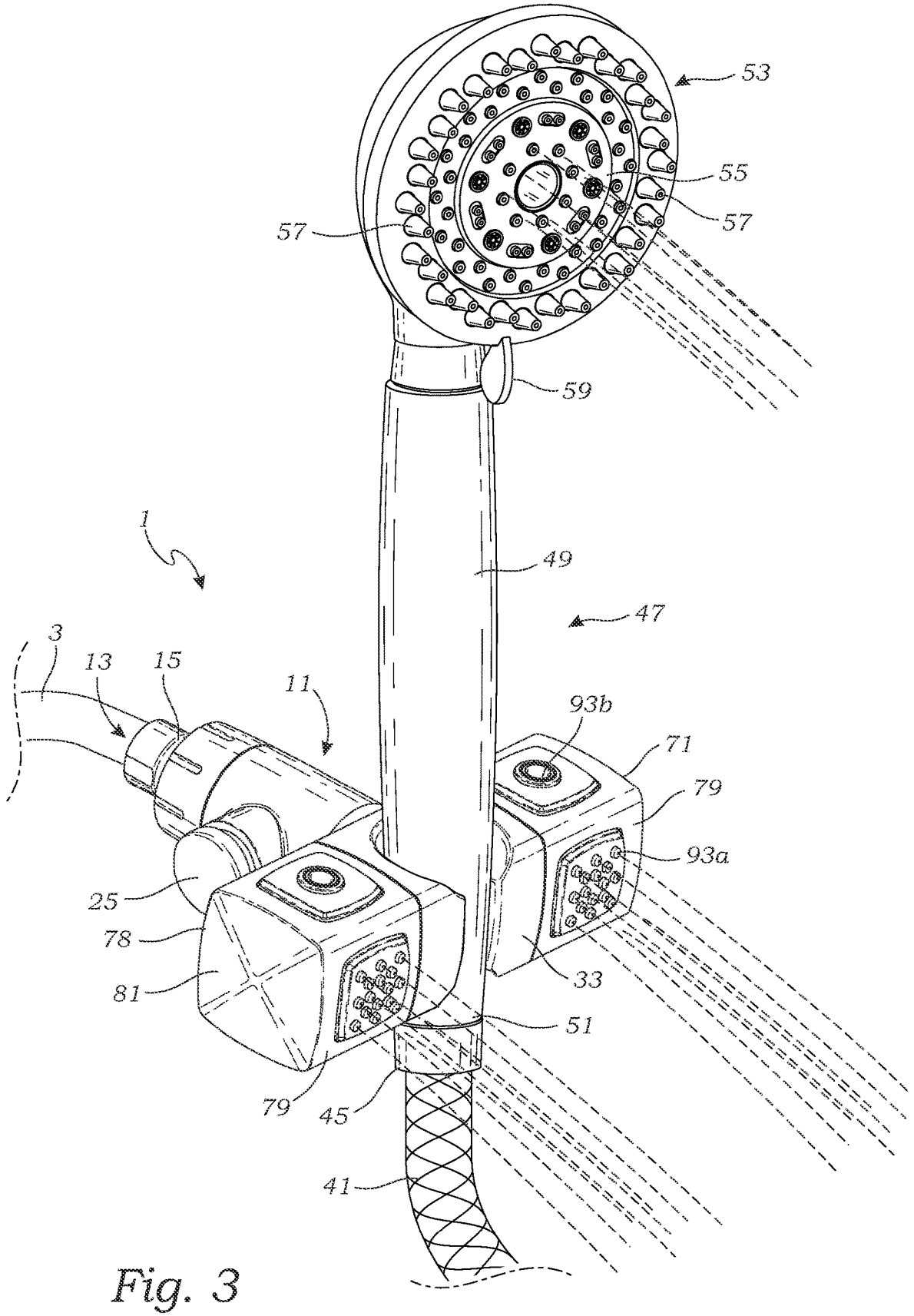
FIG. 3 is a perspective view of the showerhead assembly.

With reference to all FIGS. 1-15, the showerhead assembly 1 includes a mounting structure 11 for supporting a handheld showerhead assembly 47. With reference primarily to FIG. 3, the handheld showerhead portion of the showerhead assembly 1 has a relatively traditional construction including a hollow handle 49 having a proximal end 51 which affixes to a flexible hose 41, and a distal end which includes a showerhead 53. The handle 49 includes a longitudinal axis, and preferably the showerhead 53 affixes to the distal end of the handle 47 at an angle, such as 45° to 90°, relative to the handle's longitudinal axis. The showerhead assembly's primary showerhead 53 has a face 55 through which a plurality of nozzles 57 project. As understood by those skilled in the art, water is capable of flowing through a channel (not shown) within the center of the handle 49 which connects to the showerhead's nozzles 57 which are constructed to spray water. Preferably, but not necessarily, the showerhead 53 includes a controller, such as the controller knob 59, which is capable of altering the flow of water so as to provide the showerhead with the capability of producing different spray patterns. As illustrated in FIG. 3, preferably the handheld showerhead's hollow handle 49 has a proximal end 51 which has male threads so as to couple to the female threaded connection 45 found on a traditional flexible hose 41.

The showerhead assembly 1 has a unique hollow mounting structure 11 for holding the showerhead assembly's hollow handle 49. As illustrated in each of the Figures, the mount 11 includes an inlet 13 which connects to a water supply. Preferably, the inlet 13 includes female threads 17 for connecting to the male threads found at the end of a traditional shower stall pipe 3. Preferably, the mount's hollow housing 19 is connected to the mount's inlet 13 by a ball joint 15 which allows the mount 11 to rotate and swivel in any direction about the ball joint's center.

As illustrated in FIGS. 1-15, like traditional handheld showerhead mounting structures, the preferred mount 11 includes a housing 19 which has a central channel 21 and a hose conduit 22 which connects the mount's inlet 13 to a primary hose outlet 29. Preferably, the mount's primary hose outlet 29 includes male threads for connecting to the female threaded inlet 45 of the flexible hose 41. As illustrated in FIG. 1-15, the mount 11 includes a "C" shaped receptacle 33 for receiving the proximal end 51 of the handheld shower assembly 47. Unlike traditional handheld showerhead mounts, the mount's housing 19 has two nozzle conduits 23 (best seen in FIGS. 14 and 15) which extend from the mount's central channel 21 to supply water to water outlets 87 located on the left and right sides of the "C" shaped receptacle 33.

As illustrated in FIGS. 1-15, The mount 11 includes a pair of sprayer assemblies 71 that are rotatably attached to each side of the mount's "C" shaped receptacle. Each sprayer assembly 71 includes a housing 78 having a plurality of nozzles 93 which can be selectively activated and/or deactivated to provide different spray patterns. The preferred sprayer assemblies 71 include a six-sided housing 78 wherein each housing includes an end face 81, an engaging face 77 which engages the "C" shaped receptacle 33, and four spray faces 79. Each of the four spray faces 79 include one or more nozzles 93 (*a-d*) which are selectively connectable to the mount's nozzle conduits 23. Though the preferred sprayer assemblies 71 described and illustrated herein include four spray faces 79, the sprayer assemblies 71 may include any number of spray faces 79. As examples only, the housing 78 may have a triangular shape to provide three spray faces 79 or the housing may have a pentagonal shape to provide five spray faces.

The sprayer assemblies 71 may be affixed to each side of the "C" shaped receptacle by any of the myriad of rotating assemblies known to those skilled in the art. However, in the preferred embodiments illustrated in FIGS. 1-15, each sprayer assembly is connected to the mount's housing 19 by a post and bore construction. The mount 11 includes a pair of horizontally extending posts 83 that extend horizontally from each side of the "C" shaped receptacle, each sprayer assembly includes a bore 85 formed within each engaging face 77 for rotatable receipt of the post 83. The post 83 horizontally extends from both the "C" shaped receptacle's right side and the "C" shaped receptacle's left side into the bore 85 found within each sprayer assembly 71.

Figure 4:
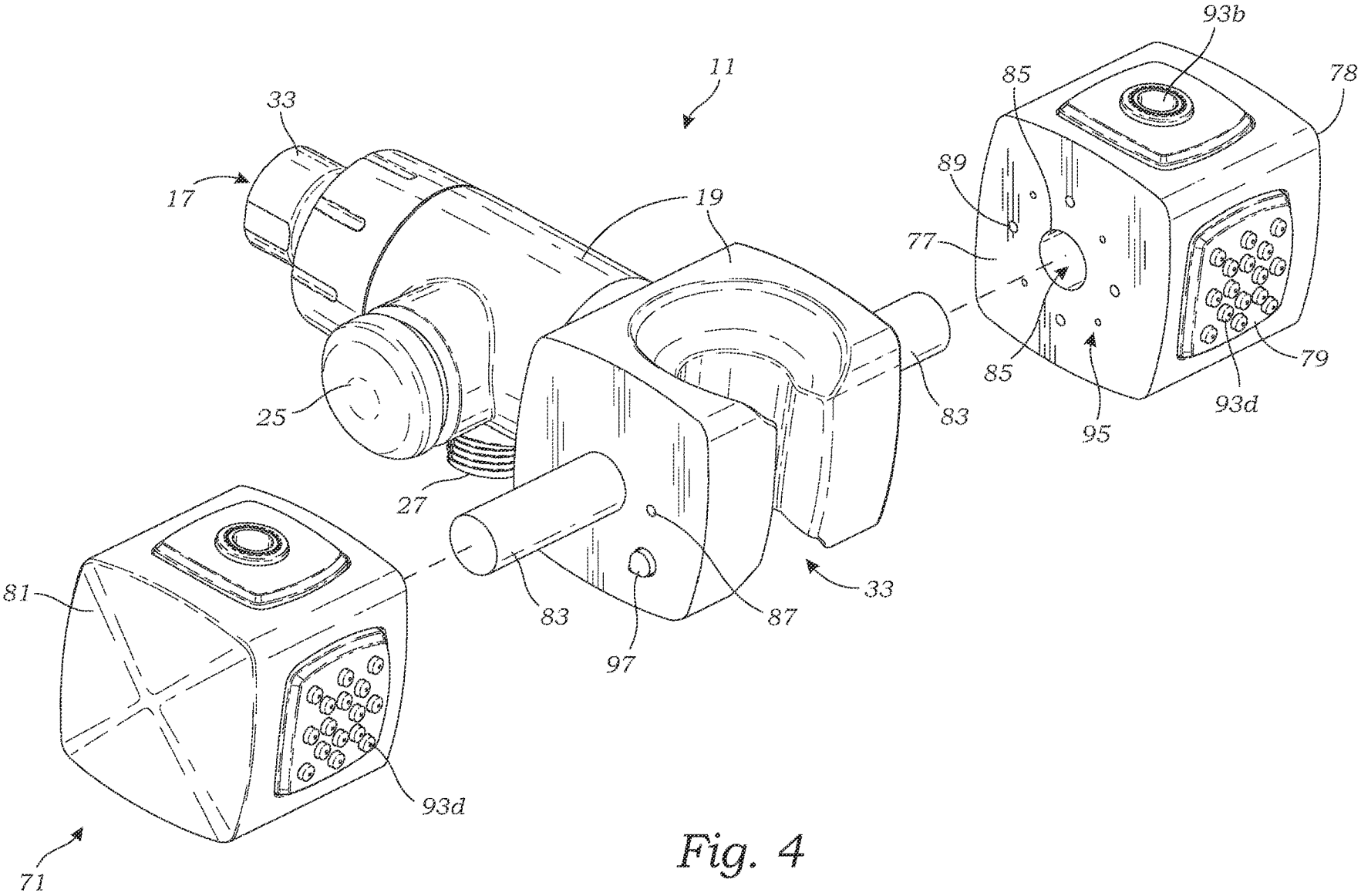
FIG. 4 is a partially exploded perspective view of the showerhead mount with rotating sprayer assemblies illustrating that the mount's C-shaped receptacle has posts extending horizontally into the rotating nozzle sprayer assemblies.
Figure 5:
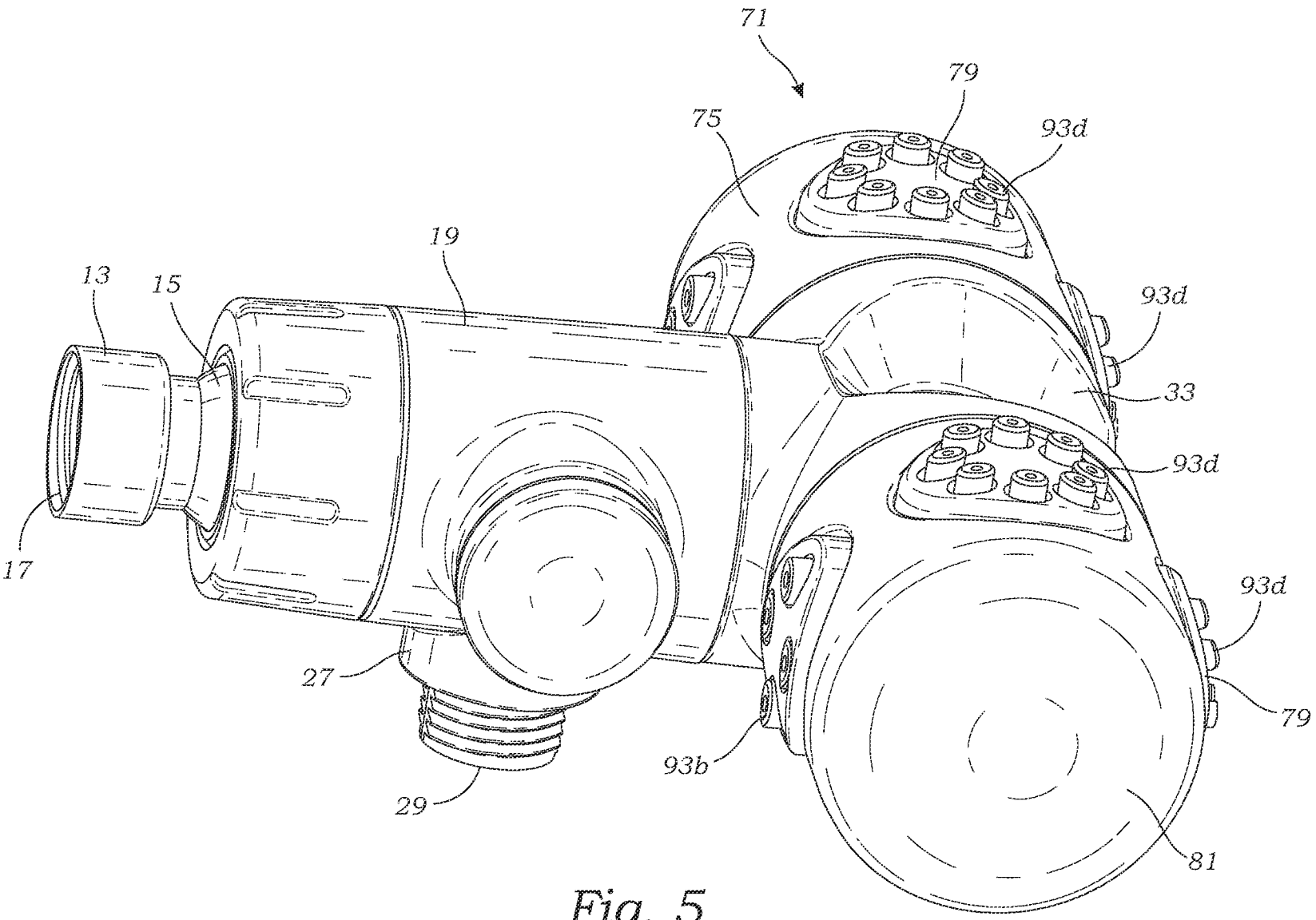
FIG. 5 is a left perspective view of the showerhead mount illustrated in FIG. 1.
Figure 6:
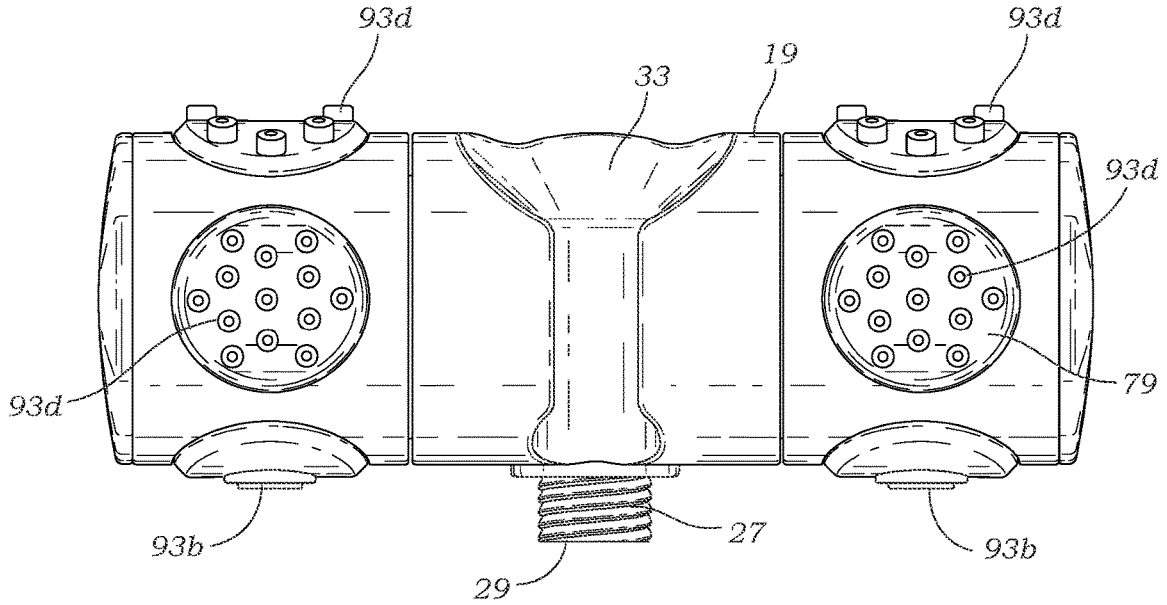
FIG. 6 is a front side view of the mount illustrated in FIG. 1.
Figure 7:
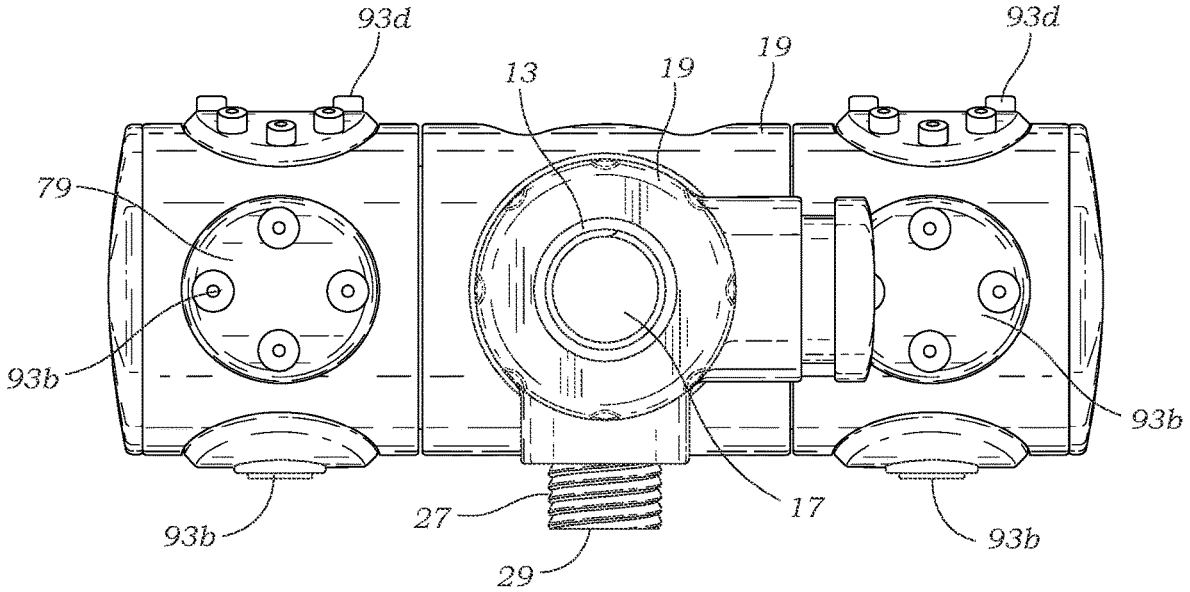
FIG. 7 is a back side view of the mount illustrated in FIG. 1.
Figure 8:
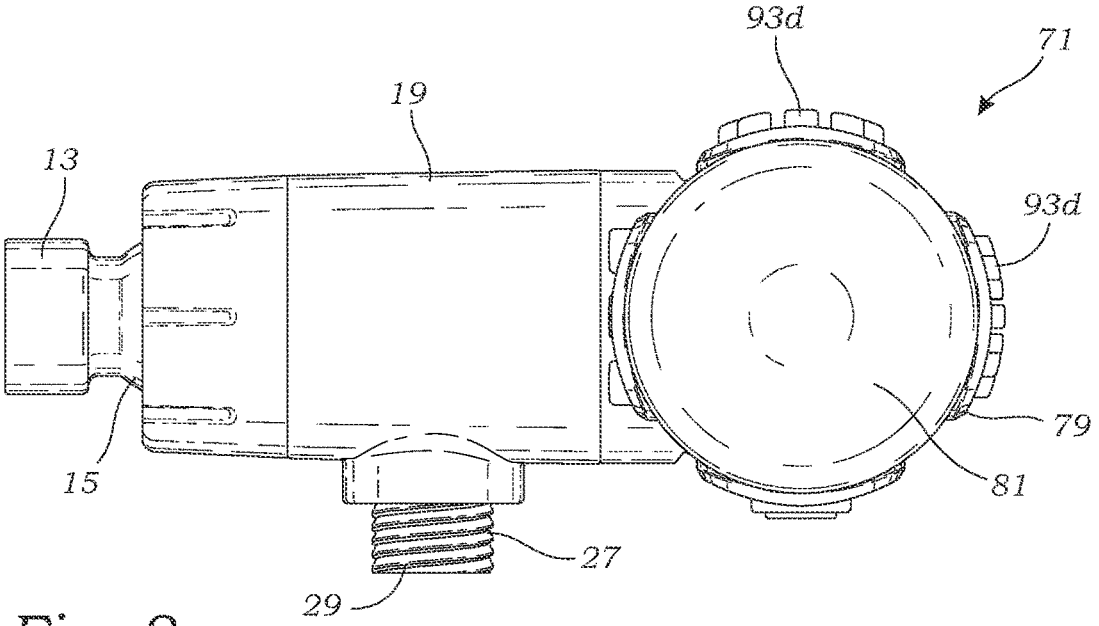
FIG. 8 is a left side view of the mount illustrated in FIG. 1.
Figure 9:
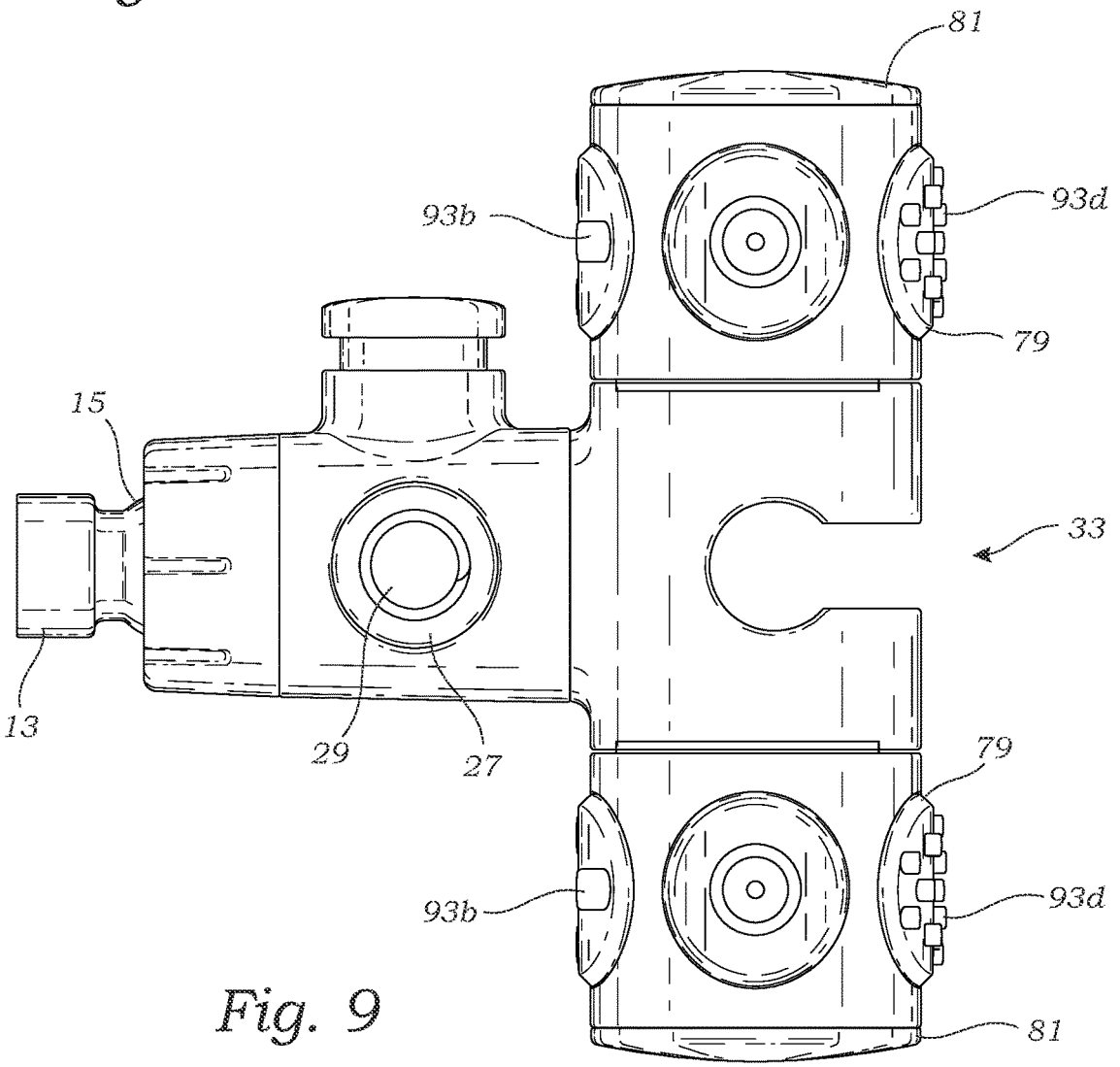
FIG. 9 is a bottom side view of the mount illustrated in FIG. 1.
Figure 10:
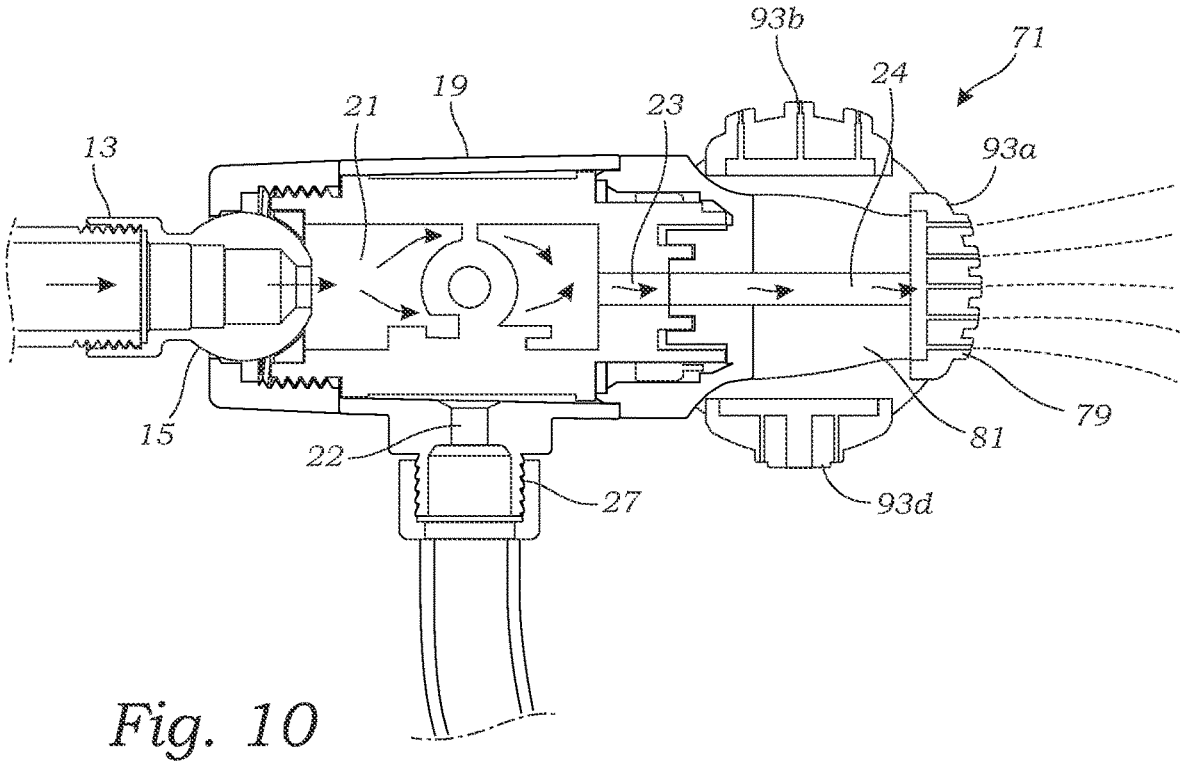
FIG. 10 is a left side cutaway view of the mount illustrated in FIG. 1 wherein the sprayer nozzle configuration has been rotated so as to expel water through a different spray nozzle face from that of FIG. 11, FIG. 12, and FIG. 13.
Figure 11:
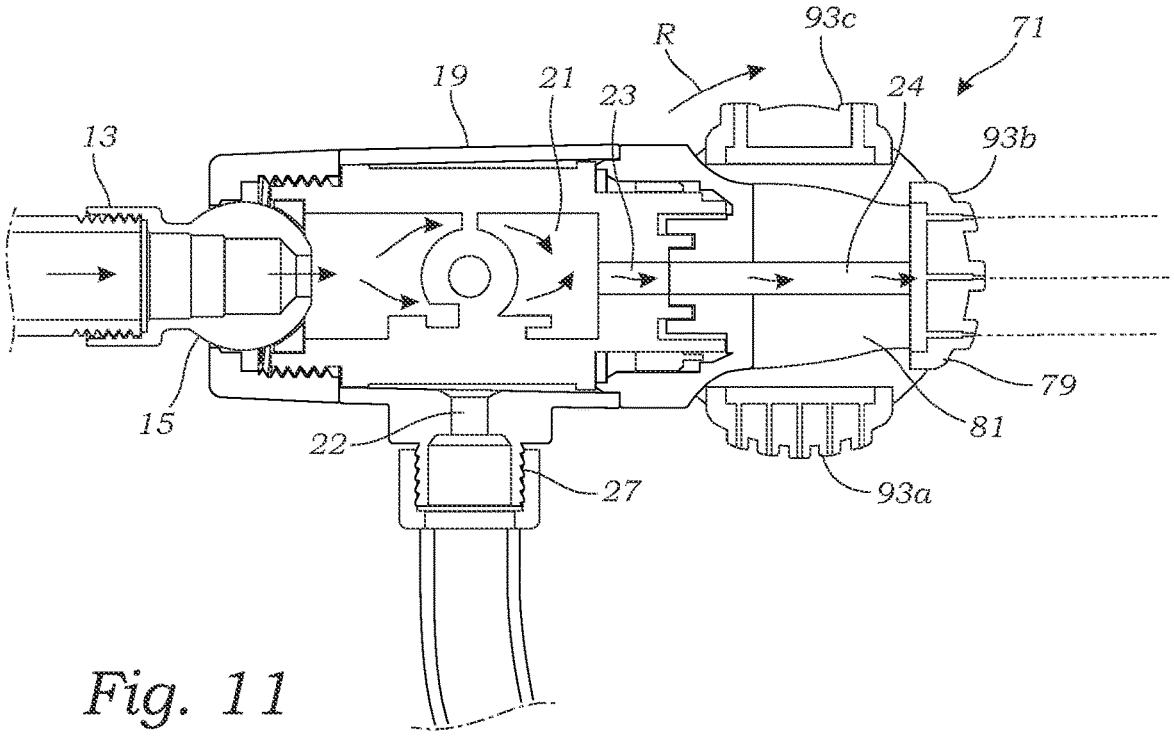
FIG. 11 is a left side cutaway view of the mount illustrated in FIG. 1 wherein the sprayer nozzle configuration has been rotated so as to expel water through a different spray nozzle face from that of FIG. 10, FIG. 12, and FIG. 13.
Figure 12:
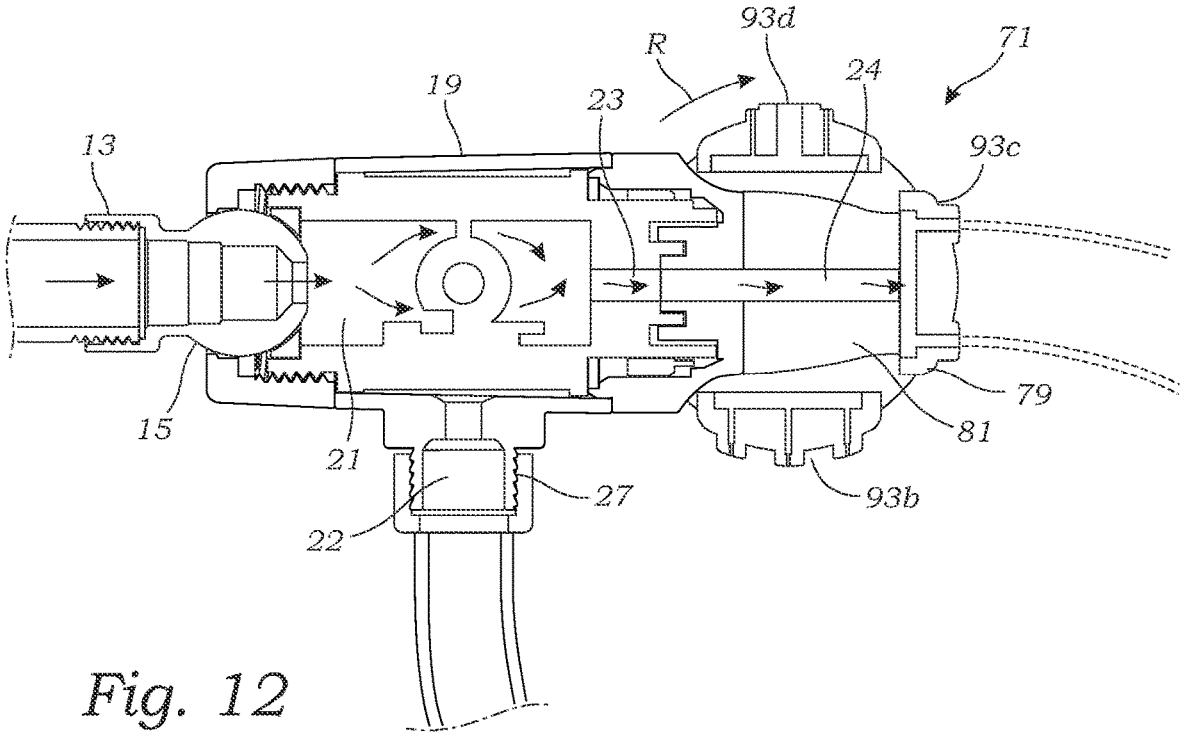
FIG. 12 is a left side cutaway view of the mount illustrated in FIG. 1 wherein the sprayer nozzle configuration has been rotated so as to expel water through a different spray nozzle face from that of FIG. 10, FIG. 11, and FIG. 13.
Figure 13:
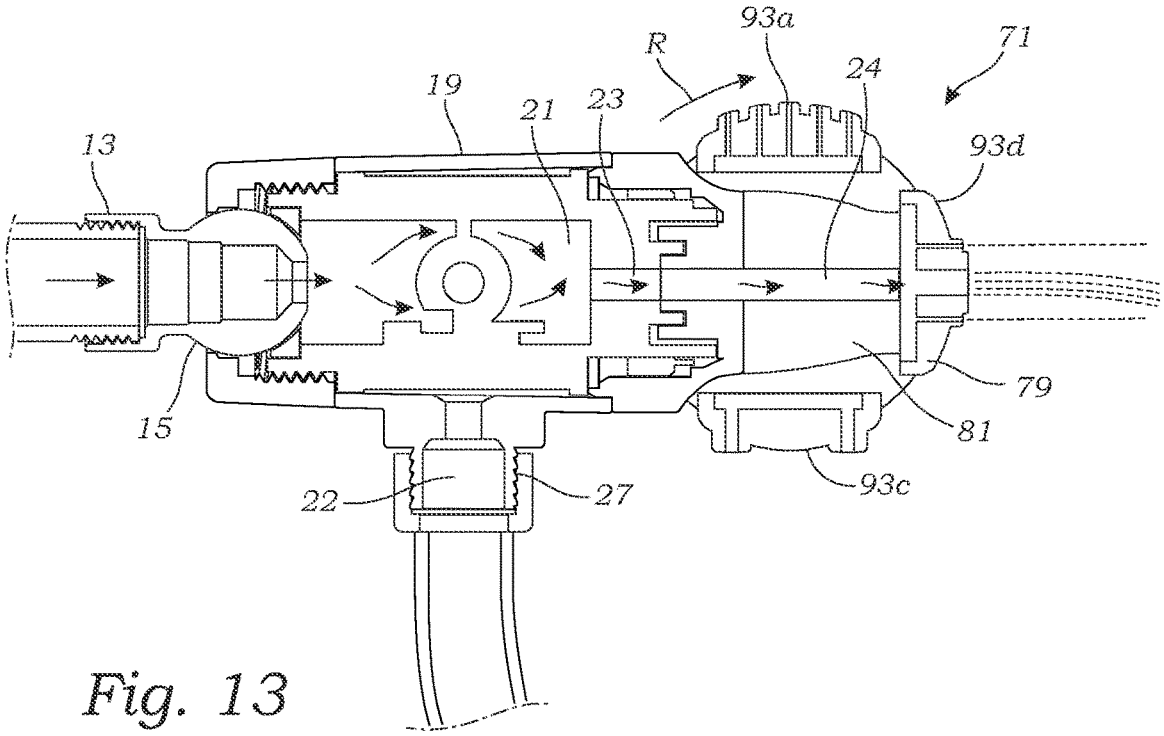
FIG. 13 is a left side cutaway view of the mount illustrated in FIG. 1 wherein the sprayer nozzle configuration has been rotated so as to expel water through a different spray nozzle face from that of FIG. 10, FIG. 11, and FIG. 12.
Figure 14:
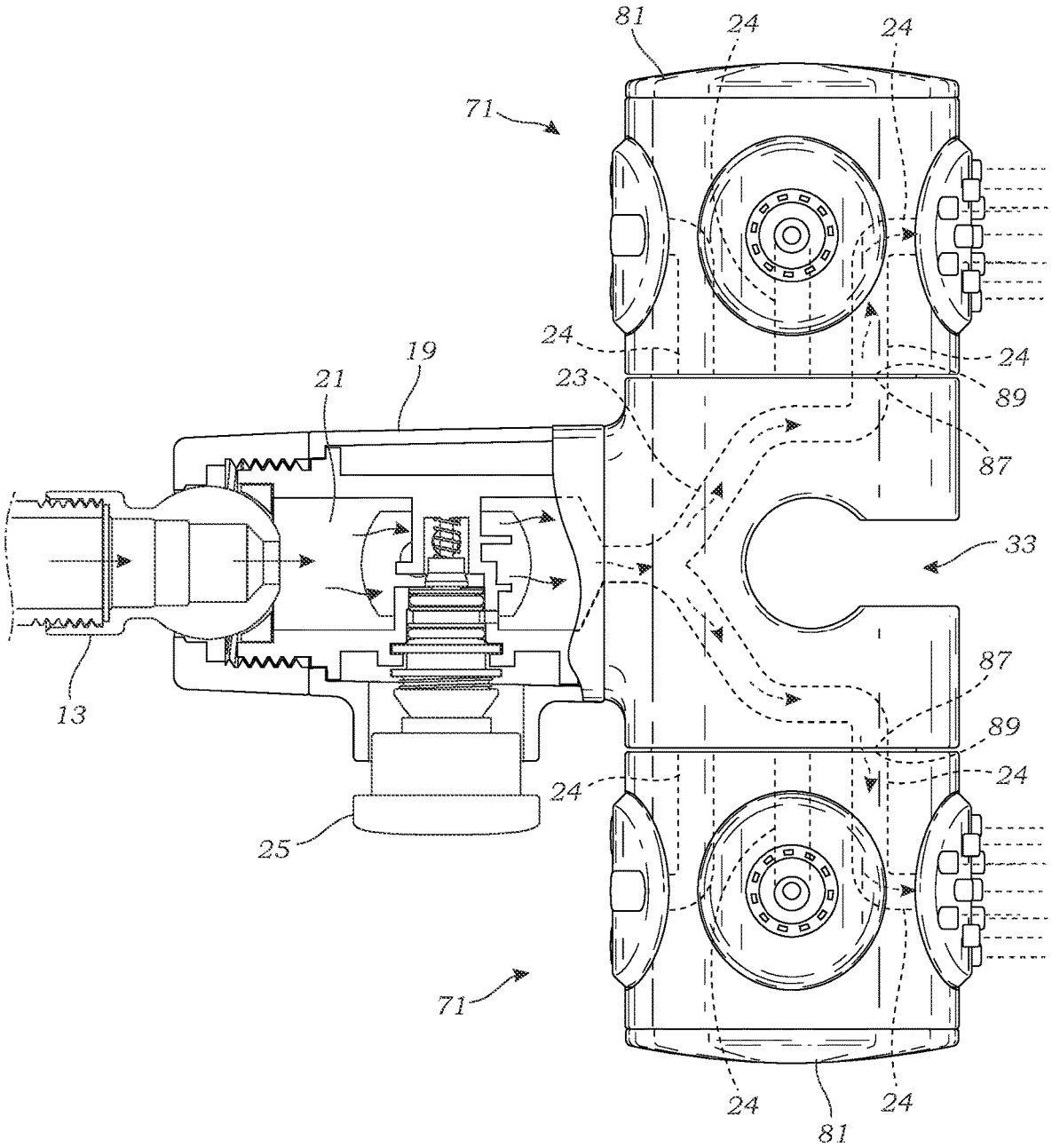
FIG. 14 is a top side cutaway view of the mount illustrated in FIG. 1 illustrating the flow of water to a flexible hose and the mount's spray nozzles.

In the preferred embodiment, the "C" shaped receptacle's water outlet 87 is intended to align and connect to any one of four water inlets 89 located on each sprayer assembly's engaging face 77. As best illustrated in FIGS. 4 and 14, each of the four water inlets 89 include a conduit 24 which extends from the sprayer assembly's engaging face 77 to the nozzles 93 of one of the four spray faces 79. As understood by one skilled in the art, when the "C" shaped receptacle's water outlet 87 aligns with one of the four sprayer assembly's water inlet 89, water is capable of passing through the mount's central channel 21, to a nozzle conduit 23, to a sprayer assembly's inlet conduit 24 so as to be expelled from nozzles 93. When the sprayer assemblies 71 are not rotated to properly align the "C" shaped receptacle's water outlet 87 with a sprayer assemblies' inlet 89, the "C" shaped receptacle's water outlet 87 is obstructed by the sprayer assembly's engaging face 77 so as to effectively turn off the sprayer assemblies' nozzles.

As best illustrated in FIG. 4, preferably each sprayer assembly's engaging face 77 has four notches 95 which are intended to align with a spring-loaded tab 97 which projects out of the mount's housing 19. Preferably this spring-loaded tab 97 engages and provides a mild lock to relative rotation of the sprayer assembly 71 to maintain the sprayer assembly's orientation properly and a "C" shaped receptacle's water outlet 87 aligns with the sprayer assembly's inlet 89. As illustrated in FIGS. 1 and 2, a user can rotate either of the two sprayer assemblies 71 about the horizontal axis 73 so as to select a desired spray face 79 and sprayer nozzles 93.

Figure 15:
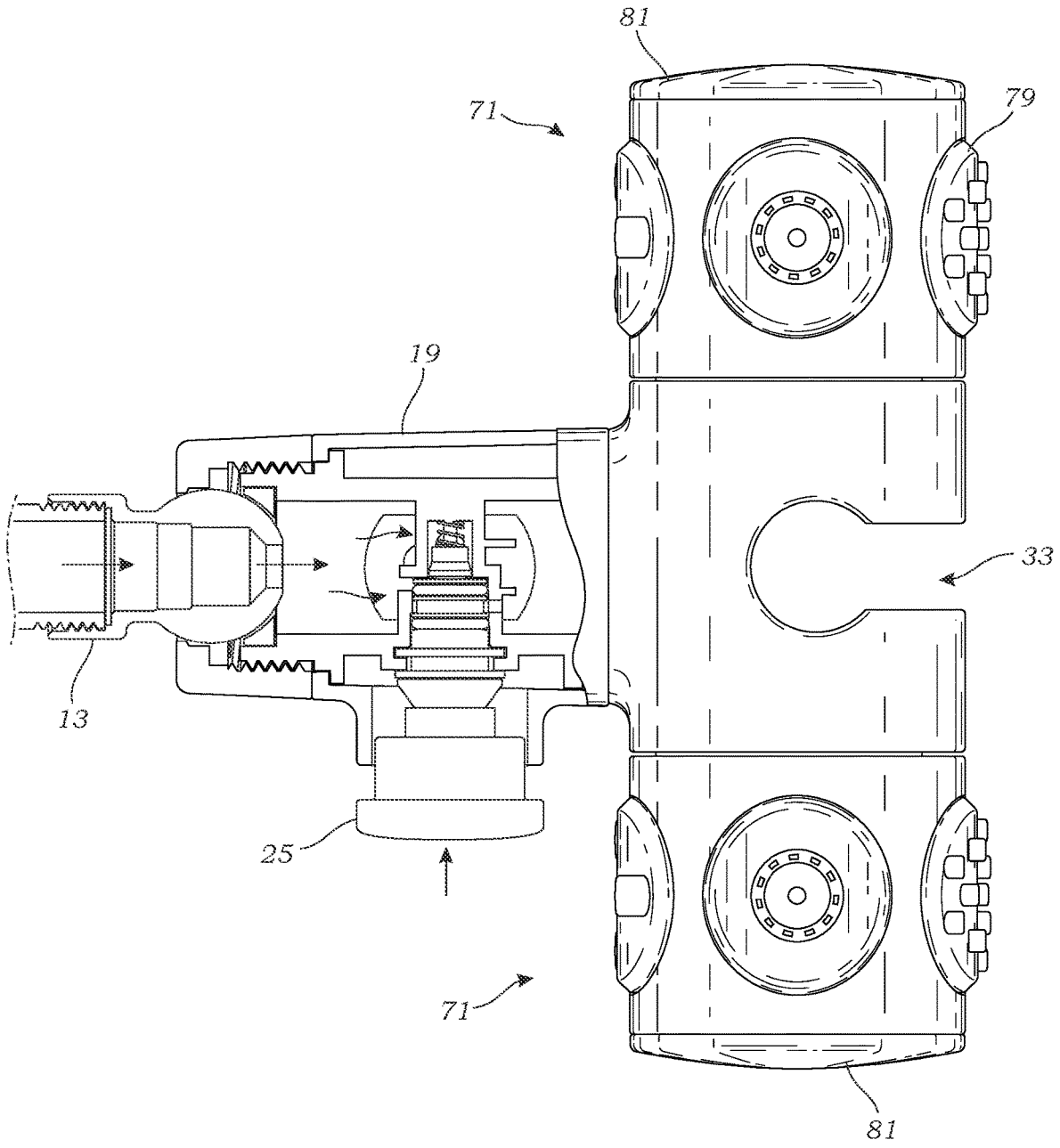
FIG. 15 is a top side cutaway view of the mount illustrated in FIG. 1 illustrating the flow of water to a flexible hose, but not to the mount nozzles.

As illustrated in FIGS. 10-15, preferably but not necessarily, the mount 11 includes an on/off valve 25 which permits or obstructs the flow of water from the housing's inlet 13 to the nozzle conduits 23. As illustrated in FIG. 15, the preferred valve consists of an on/off button 25 with depression of the button causing the central channel 21 to close to prevent water from flowing to the nozzle conduits 23. For example, FIGS. 10-14 illustrate the valve button 25 not depressed to allow water to flow through the central channel 21 to the sprayer assemblies 71. Conversely, FIG. 15 illustrates the valve button depressed in order to obstruct the flow of water through central channel 21 to the nozzle conduits 23. This valve construction 25 may be incorporated into any mount embodiments including the embodiment illustrated in FIGS. 1-14. Furthermore, the showerhead assembly may incorporate additional or alternative valve assemblies. For example, a preferred valve (not shown) may be capable of activating or deactivating any of the valve assemblies such as a valve which provides three modes including: 1) on—mount nozzles and on—handheld showerhead; 2) on—mount nozzles and off—handheld showerhead; and 3) off—mount nozzles and on—handheld showerhead. The mount may also incorporate a valve assembly (not shown) which can selectively activate or deactivate either of the two mount spray assemblies, such as to activate the left mount nozzles but deactivate the right mount nozzles, or to deactivate the left mount nozzles but activate the right mount nozzles. Various valve constructions for providing these capabilities can be selected by those skilled in the art.

The present shower assembly provides an improved mounting structure for holding a handheld shower assembly which includes supplemental sprayer assemblies.

Advantageously, each sprayer assembly is capable of rotating both upwardly about the horizontal axis, so as to change the nozzle configuration and enable the bather to choose their desired spray pattern via rotation of each housing.

Also, advantageously, the mount provides a variety of different nozzle configurations which provide supplemental streams of water. Preferred showerhead assemblies have been illustrated and described herein, it will be apparent that various modifications can be made without departing from the spirit and scope of the invention. For example, preferred showerhead mounts may include only a single sprayer assembly, or the mount may possess three or more sprayer assemblies. However, the preferred showerhead assemblies described and illustrated herein include a mount having two adjustable sprayer assemblies. Still alternative embodiments may be envisioned by those skilled in the art after consideration of the present disclosure. Accordingly, it will be apparent that various modifications can be made without departing from the spirit and scope of the invention. Therefore, having described my invention in such terms such as to enable a person skilled in the art to understand the invention, recreate the invention and practice it, and having presently identified the presently preferred embodiments thereof,

I claim:

1. A handheld showerhead assembly comprising:

a handheld showerhead including a primary showerhead and an elongate hollow handle, said primary showerhead having a front face and a plurality of nozzles projecting from said front face, said elongate hollow handle having a proximal end and a distal end with said distal end affixed to said primary showerhead, said handheld showerhead further including a handle channel connecting said elongate hollow handle's proximal end to said plurality of nozzles for transporting water received from said handle's proximal end to said plurality of nozzles;

a hose having first and second ends with said first end being connected to said elongate handle's proximal end;

a showerhead mount including a housing, a female threaded inlet, an outlet which is connected to said hose's second end, and a central channel connecting said female threaded inlet to said outlet, said housing further including a "C" shaped receptacle sized and shaped to receive and hold the proximal end of said handheld showerhead, said "C" shaped receptacle having left and right sides, and said "C" shaped receptacle having a nozzle conduit which extends from said central channel to said "C" shaped receptacle's left side;

said showerhead mount including a left sprayer assembly that is rotatably attached to said "C" shaped section's left side so as to rotate about a horizontal axis that extends laterally relative to said "C" shaped receptacle, said left sprayer assembly having an end face, a plurality of spray faces with each spray face having one or more nozzles, and an engaging face which is perpendicular to said plurality of spray faces and wherein said left sprayer assembly's engaging face engages said "C" shaped receptacle's left side;

said left sprayer assembly's engaging face including a plurality of inlets with each inlet in fluid communication with said one or more nozzles of one of said plurality of spray faces by a plurality of conduits, each of said conduits curving so as to be capable of communicating water from said left sprayer assembly's engaging face to said perpendicularly positioned spray faces, said plurality of inlets located upon said engaging faces such that rotation of said left sprayer assembly allows each of said plurality of inlets to selectively align and engage with said nozzle conduit to allow water to be expelled from one of said left sprayer assembly's spray faces, said plurality of inlets being obstructed when said plurality of inlets are not aligned and engaged to one of said nozzle conduits.

2. The handheld showerhead assembly of claim 1 wherein:

said showerhead mount includes a post that extends horizontally from said "C" shaped receptacle's left side;

said left sprayer assembly includes a bore for rotatable receipt of said post which enables said left sprayer assembly to rotate relative to said "C" shaped receptacle.

3. The handheld showerhead assembly of claim 1 wherein:

said "C" shaped receptacle's left side includes a spring loaded tab; and said left sprayer assembly's engaging face includes a plurality of notches that align and engage with said spring-loaded tab to provide a lock to relative rotation of said left sprayer assembly when said "C" shaped receptacle's nozzle conduit is aligned with one of said left sprayer assembly's inlets to maintain orientation for water to be expelled from said left sprayer assembly.

4. The handheld showerhead assembly of claim 1 wherein said hollow handle extends longitudinally to define a longitudinal axis, and said showerhead's front face faces at an angle between 45° and 90° relative to said handle's longitudinal axis.

5. The handheld showerhead assembly of claim 1 wherein said hollow handle extends longitudinally to define a longitudinal axis, and said showerhead's front face faces at an angle between 45° and 90° relative to said handle's longitudinal axis, and said left sprayer assembly sprays water in substantially the same direction that said primary showerhead sprays water.

6. A handheld showerhead assembly comprising:

a handheld showerhead including a primary showerhead and an elongate hollow handle, said primary showerhead having a front face and a plurality of nozzles projecting from said front face, said elongate hollow handle having a proximal end and a distal end with said distal end affixed to said primary showerhead, said handheld showerhead further including a handle channel connecting said elongate hollow handle's proximal end to said plurality of nozzles for transporting water received from said handle's proximal end to said plurality of nozzles;

a hose having first and second ends with said first end being connected to said elongate handle's proximal end;

a showerhead mount including a housing, a female threaded inlet, an outlet which is connected to said hose's second end, and a central channel connecting said female threaded inlet to said outlet, said housing further including a "C" shaped receptacle sized and shaped to receive and hold the proximal end of said handheld showerhead, said "C" shaped receptacle having left and right sides, and said "C" shaped receptacle having a nozzle conduit which extends from said central channel to said "C" shaped receptacle's right side;

said showerhead mount including a right sprayer assembly that is rotatably attached to said "C" shaped section's right side so as to rotate about a horizontal axis that extends laterally relative to said "C" shaped receptacle, said right sprayer assembly having an end face, a plurality of spray faces with each spray face having one or more nozzles, and an engaging face which is perpendicular to said plurality of spray faces and wherein said right sprayer assembly's engaging face engages said "C" shaped receptacle's right side;

said right sprayer assembly's engaging face including a plurality of inlets with each inlet in fluid communication with said one or more nozzles of one of said plurality of spray faces by a plurality conduits, each of said conduits curving so as to be capable of communicating water from said left sprayer assembly's engaging face to said perpendicularly positioned spray faces, said plurality of inlets located upon said engaging faces such that rotation of said right sprayer assembly allows each of said plurality of inlets to selectively align and engage with said nozzle conduit to allow water to be expelled from one of said right sprayer assembly's spray faces, said plurality of inlets being obstructed when said plurality of inlets are not aligned and engaged to one of said nozzle conduits.

7. The handheld showerhead assembly of claim 6 wherein:

said showerhead mount includes a post that extends horizontally from said "C" shaped receptacle's right side;

said right sprayer assembly includes a bore for rotatable receipt of said post which enables said right sprayer assembly to rotate relative to said "C" shaped receptacle.

8. The handheld showerhead assembly of claim 6 wherein:

said "C" shaped receptacle's right side includes a spring loaded tab; and said right sprayer assembly's engaging face includes a plurality of notches that align and engage with said spring-loaded tab to provide a lock to relative rotation of said right sprayer assembly when said "C" shaped receptacle's nozzle conduit is aligned with one of said right sprayer assembly's inlets to maintain orientation for water to be expelled from said right sprayer assembly.

9. The handheld showerhead assembly of claim 6 wherein said hollow handle extends longitudinally to define a longitudinal axis, and said showerhead's front face faces at an angle between 45° and 90° relative to said handle's longitudinal axis.

10. The handheld showerhead assembly of claim 6 wherein said hollow handle extends longitudinally to define a longitudinal axis, and said showerhead's front face faces at an angle between 45° and 90° relative to said handle's longitudinal axis, and said right sprayer assembly sprays water in substantially the same direction that said primary showerhead sprays water.

* * * * *